US011027559B2

(12) United States Patent
Busch et al.

(10) Patent No.: US 11,027,559 B2
(45) Date of Patent: Jun. 8, 2021

(54) EXPANDING A COLOR GAMUT OF A DIRECT THERMAL PRINTER

(71) Applicant: ZINK HOLDINGS, LLC, Billerica, MA (US)

(72) Inventors: Brian D. Busch, Sudbury, MA (US); James Peter Zelten, Melrose, MA (US)

(73) Assignee: ZINK HOLDINGS, LLC, Billerica, MA (US)

( * ) Notice: Subject to any disclaimer, the term of this patent is extended or adjusted under 35 U.S.C. 154(b) by 0 days.

(21) Appl. No.: 16/432,555

(22) Filed: Jun. 5, 2019

(65) Prior Publication Data

US 2020/0122480 A1 Apr. 23, 2020

Related U.S. Application Data

(60) Provisional application No. 62/746,819, filed on Oct. 17, 2018.

(51) Int. Cl.
*B41J 2/36* (2006.01)

(52) U.S. Cl.
CPC ..... *B41J 2/36* (2013.01)

(58) Field of Classification Search
CPC ..... B41J 2/36
See application file for complete search history.

(56) References Cited

U.S. PATENT DOCUMENTS

2006/0290769 A1* 12/2006 Liu ..... B41J 2/36 347/144
2009/0309946 A1* 12/2009 Saquib ..... B41J 2/365 347/191
2019/0042901 A1* 2/2019 d'Armancourt ... G06K 15/4095

* cited by examiner

*Primary Examiner* — Lamson D Nguyen
(74) *Attorney, Agent, or Firm* — Adler Pollock & Sheehan P.C; Michel Morency

(57) ABSTRACT

A method and apparatus for expanding a color gamut of a direct thermal printer is described. The method includes, in a three-color direct thermal printer having at least a print head, the print head including print head elements, dynamically adjusting a duty cycle of at least one of the colors depending on the color to be printed in each pixel of an image.

6 Claims, 8 Drawing Sheets

EXPANDING A COLOR GAMUT OF A DIRECT THERMAL PRINTER

CROSS REFERENCE TO RELATED APPLICATIONS

This application claims the benefit of priority to US provisional application U.S. Ser. No. 62/746,819, filed Oct. 17, 2018, the disclosure of which is incorporated by reference as if fully set forth herein in its entirety.

FIELD OF THE INVENTION

The embodiments of the present invention relate to generally to thermal printing, and more specifically to expanding the color gamut of a direct thermal printer.

BACKGROUND OF THE INVENTION

In general, a thermal transfer printer is a non-impact printer that uses heat to register an impression on paper. In some implementations, a thermal transfer printer has a printhead containing many small resistive heating elements that on contact, depending on the type of thermal printer, either melt wax-based ink onto ordinary paper or colorize dots on special coated paper. The former are called thermal transfer printers, while the latter are called direct thermal printers. A microprocessor determines which individual heating elements are heated to produce the printed image. Thus, unlike inkjet printers, thermal printers don't spray liquid ink through a nozzle to produce images. Rather, thermal printers use tiny heating elements to transfer or to colorize pigments or dyes. The microprocessor generally applies a series of pulses of electrical energy to the heating elements, controlling the temperature of the elements by adjusting the number, length and timing of the pulses. More generally, in thermal printing, heat is applied selectively to produce an image on a surface of a print member.

One area in which direct thermal printers currently provide somewhat poorer performance than competing technologies is in their color gamut.

SUMMARY OF THE INVENTION

The following presents a simplified summary of the innovation in order to provide a basic understanding of some aspects of the invention. This summary is not an extensive overview of the invention. It is intended neither to identify key or critical elements of the invention nor to delineate the scope of the invention. Its sole purpose is to present some concepts of the invention in a simplified form as a prelude to the more detailed description that is presented later.

The present invention provides methods and apparatus, including computer program products, for expanding the color gamut of a direct thermal printer.

In an aspect, the invention features a method including, in a three-color direct thermal printer having at least a print head, the print head having print head elements, dynamically adjusting a duty cycle of the applied heating pulses of at least one of the colors depending on the color to be printed in each pixel of an image.

In another aspect, the invention features a system including a control circuit, and one or more print heads linked to the control circuit, each of the one or more print heads containing a linear array of print head elements that print on an output medium, the output medium transported past the print head elements to produce a two-dimensional print image, the print image resulting from heating of the output medium by dynamically adjusting an average applied power to the individual print head elements to heat them.

In still another aspect, the invention features a direct thermal printer including a thermal print head including heating elements, and a control circuit connected to the thermal print head that applies, during a first portion of a printing time, a first pulse pattern to the heating elements, and that applies, during a second portion of the printing time, a second pulse pattern to the heating elements.

In yet another aspect, the invention features a method including providing a direct thermal printer having a thermal print head that includes heating elements, applying a first pulse pattern to the heating elements during a first portion of a printing time, the first pulse pattern including a first set of pulses having a first average power, each of the first set of pulses having a common energy, and applying a second pulse pattern to the heating elements during a second portion of the printing time, the second pulse pattern including a second set of pulses having a second average power that differs from the first average power, each of the second set of pulses having the common energy.

The invention may include one or more of the following advantages.

A method for electrically activating thermal print head elements that mitigates the effect of color cross-talk in a direct thermal printer.

A method that dynamically modifies, on a pixel-by-pixel basis, the time-average power supplied to each print head element in a fashion that enlarges the color gamut of a direct thermal printer.

A method that chooses the average power level of a pulse stream supplied to a direct thermal printer print head element during the segment designated for printing on an intermediate color forming layer dynamically on a pixel-by-pixel basis.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

For the purpose of illustration, certain embodiments of the present invention are shown in the drawings described below. Like numerals in the drawings indicate like elements throughout. It should be understood, however, that the invention is not limited to the precise arrangements, dimensions, and instruments shown. In the drawings.

DETAILED DESCRIPTION

Figure 1:
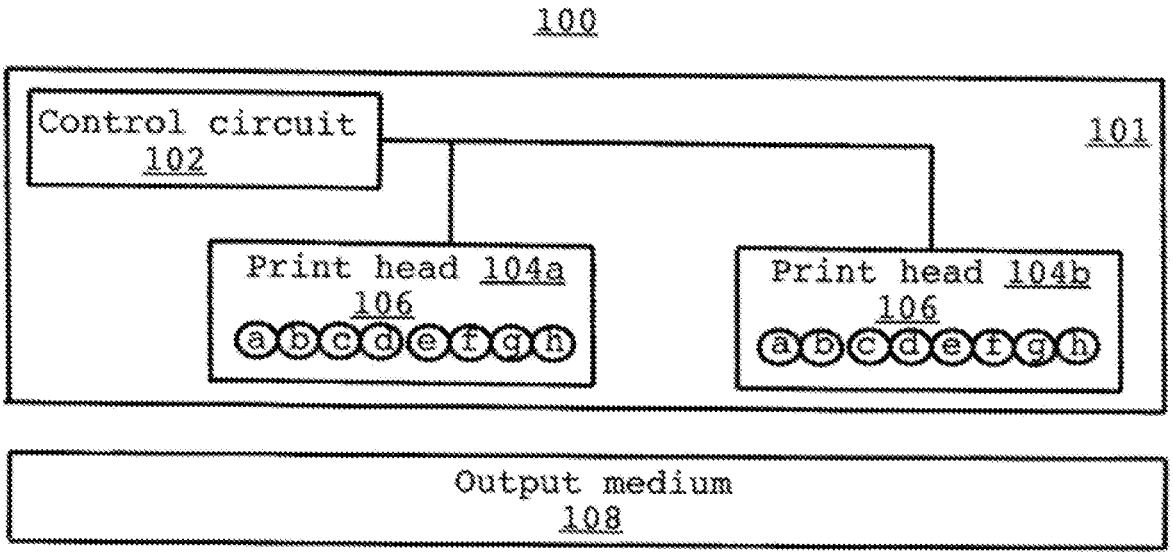
FIG. 1 is a block diagram of an exemplary direct thermal printing system.

It is to be appreciated that certain aspects, modes, embodiments, variations and features of the invention are described below in various levels of detail in order to provide a substantial understanding of the present invention. The subject innovation is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

The following description of particular aspect(s) is merely exemplary in nature and is in no way intended to limit the scope of the invention, its application, or uses, which may, of course, vary. The invention is described with relation to the non-limiting definitions and terminology included herein. These definitions and terminology are not designed to function as a limitation on the scope or practice of the invention but are presented for illustrative and descriptive purposes only. While the compositions or processes are described as using specific materials or an order of individual steps, it is appreciated that materials or steps may be interchangeable such that the description of the invention may include multiple parts or steps arranged in many ways as is readily appreciated by one of skill in the art.

Definitions

The definitions of certain terms as used in this specification and the appended claims are provided below. Unless defined otherwise, all technical and scientific terms used herein generally have the same meaning as commonly understood by one of ordinary skill in the art to which this invention belongs.

As used in this specification and the appended claims, the singular forms "a," "an" and "the" include plural referents unless the content clearly dictates otherwise. For example, reference to "an element" includes a combination of two or more elements, and the like.

As used herein, the term "approximately" or "about" in reference to a value or parameter are generally taken to include numbers that fall within a range of 5%, 10%, 15%, or 20% in either direction (greater than or less than) of the number unless otherwise stated or otherwise evident from the context (except where such number would be less than 0% or exceed 100% of a possible value). As used herein, reference to "approximately" or "about" a value or parameter includes (and describes) embodiments that are directed to that value or parameter. For example, description referring to "about X" includes description of "X".

As used herein, the term "or" means "and/or." The term "and/or" as used in a phrase such as "A and/or B" herein is intended to include both A and B; A or B; A (alone); and B (alone). Likewise, the term "and/or" as used in a phrase such as "A, B, and/or C" is intended to encompass each of the following embodiments: A, B, and C; A, B, or C; A or C; A or B; B or C; A and C; A and B; B and C; A (alone); B (alone); and C (alone).

It is understood that wherever embodiments are described herein with the language "comprising" otherwise analogous embodiments described in terms of "consisting of" and/or "consisting essentially of" are also provided. It is also understood that wherever embodiments are described herein with the language "consisting essentially of" otherwise analogous embodiments described in terms of "consisting of" are also provided.

It is to be appreciated that certain features of the invention which are, for clarity, described herein in the context of separate embodiments, may also be provided in combination in a single embodiment. Conversely, various features of the invention that are, for brevity, described in the context of a single embodiment, may also be provided separately or in any subcombination. Further, reference to values stated in ranges include each and every value within that range.

Unless otherwise defined, all terms (including technical and scientific terms) used herein have the same meaning as commonly understood by one of ordinary skill in the art to which this disclosure belongs. It will be further understood that terms such as those defined in commonly used dictionaries, should be interpreted as having a meaning that is consistent with their meaning in the context of the relevant art and the present disclosure, and will not be interpreted in an idealized or overly formal sense unless expressly so defined herein.

Direct Thermal Printing Systems

As shown in FIG. 1, an exemplary direct thermal printing system 100 includes a direct thermal printer 101. The direct thermal printer 101 includes control circuit 102 and one or more print heads 104*a-b*, each containing a linear array of heating elements 106*a-h* (also referred to as "print head elements") that print on an output medium 108. The output medium 108 is transported past the print head elements 106*a-h* to produce a two-dimensional image. The printing results from heating of the output medium 108 by applying electrical pulses to the individual print head elements 106*a-h* to heat them.

Each of the print head elements 106 *a-h*, when electrically activated, produces a colored spot on a portion of the passing output medium 108. Regions with larger or denser spots are perceived as darker than regions with smaller or less-dense spots. Digital images are rendered as two-dimensional arrays of very small and closely-spaced spots.

Printers of this type are generally divided into two broad categories, known respectively as "thermal transfer printers" and "direct thermal printers." Thermal transfer printers use the thermal energy from the print head elements to transfer pigment or dye from a donor ribbon to the output medium 108. The mechanism for this transfer may be mass transfer of a melted colored wax or resin, or thermal diffusion or sublimation of a colorant from one solid layer to another. Direct thermal printers use thermal energy from the print head element to activate a color-forming chemistry that pre-exists in the output medium 108. The direct thermal printer does not require a donor ribbon.

A density of the output produced by the print head element is a function of the amount of electrical energy provided to the print head element. It may be varied, for example, by varying the amount of power provided to the print head element within a particular time interval, or by providing a fixed power to the print head element for a longer or shorter time interval.

In the case of thermal transfer printers, the colorant is provided by a separate donor sheet that is coated with a colored material. To form multicolor images, it is necessary to provide donor ribbons with coatings of several different colors. Normally, this is accomplished either by providing multiple ribbons, each with a coating of a different color, or else by providing a single ribbon with successive patches of different color. The use of one or more such donor ribbons increases the complexity and cost, and decreases the convenience, of thermal transfer printers. It is simpler to have a single-sheet imaging system, such as that of a direct-thermal printer having color forming chemistry embedded within the output medium 108 itself.

To print multicolor images in a single pass on output medium 108 without the use of donor ribbons, the printer 102 prints these images by heating three color-forming layers within the output medium 108 at least partially independently by heating a single surface so that each color can be printed alone or in selectable proportion with the other colors. An electronic pulsing technique makes this outcome possible using electrical pulses of uniform amplitude and duration. For example, in FIG. 2, an exemplary graph 200 is shown that plots the voltage applied to a single print head element over time. Line interval 204 is subdivided into a number of subintervals 206 *a-z*. In each of the subintervals, the print head element may receive an electrical pulse. In the example illustrated in FIG. 2, pulses 210 *a-d* are provided in each of the subintervals 206 *a-d*.

Figure 2:
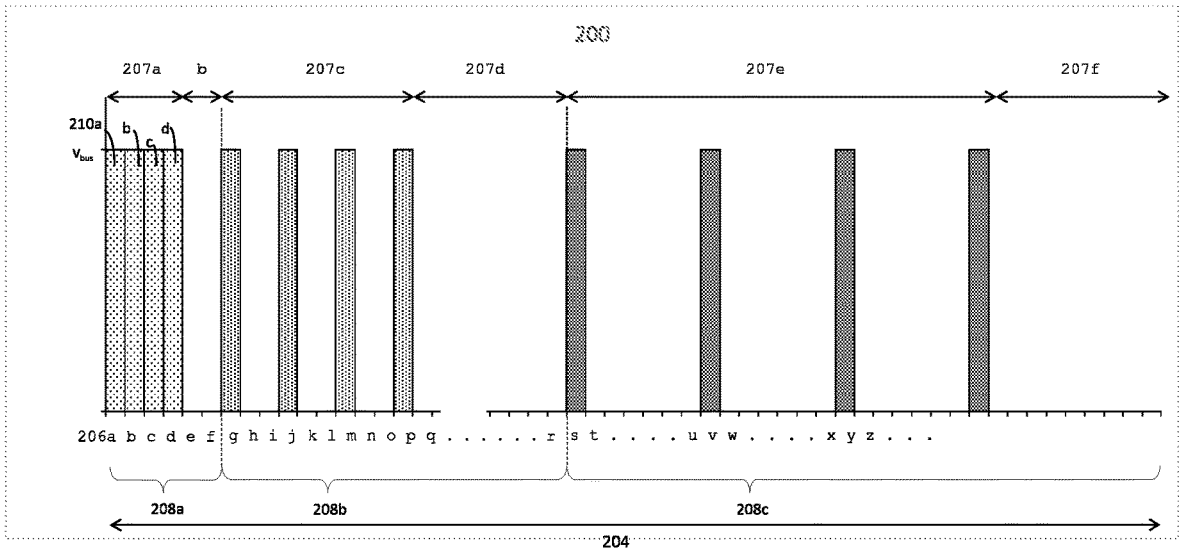
FIG. 2 illustrates the voltage applied to a single print head element over time.

Furthermore, the line interval 204 can be divided into three segments, 208*a-c*, each containing a portion of the subintervals, as shown by the graph 200 in FIG. 2. The segments 208*a-c* can each be further subdivided into two or more portions. In the example of FIG. 2, segment 208*b* is divided into portions 207*c* and 207*d*. One portion (207*c*) contains successive subintervals (206*g-p*), a regularly spaced fraction of which contain electrical pulses. This portion of the segment is known as the "on-time" portion. The other portion, containing subintervals 206 *q-r*, contains no pulses and is known as the "off-time" portion. In this example the "on-time" portion is shown as coming before the "off-time" portion, but the order can be altered and the length of either portion can be zero, depending on the color to be printed.

Line interval 204 is thereby divided into three segments 208*a*, 208*b* and 208*c*, and further subdivided into "on-time" portions 207*a*, 207*c* and 207*e*, and "off-time" portions 207*b*, 207*d* and 207*f*. The pulses in each on-time are of equal amplitude and width but are spaced differently such that the average electrical power applied to the print head element during each is different. When pulses are supplied in every interval, as shown for the first portion of segment 208*a* in FIG. 2, the average applied electrical power is relatively high. Conversely, when the pulses are applied during infrequent subintervals as shown for portion 1 of segment 208*c* in FIG. 2, the average applied electrical power is relatively low. The pulse spacing determines the average electrical power being applied to the print head element during each on-time and is used to select a particular color to print, as will be described presently.

This method of changing the average applied electrical power is particularly suited to the use of conventional thermal print heads. Such print heads apply electrical power to selected print head elements from a single voltage supply, and under the control of one, or of a small number, of "strobe" signals. A large number, or perhaps all, of the print head elements in a print head are turned on and off by a single strobe signal. It is therefore a practical necessity that all print head elements selected for heating at any time are activated by electrical pulses with a common voltage and pulse width.

Pulsing schemes in which different print head elements print with different average power level at the same time are possible despite the use of pulses of uniform amplitude and width. All print head elements are activated by electrical pulses of the same amplitude and width, but some are selected for activation more frequently (i.e., at higher average power), and some less frequently (i.e., at a lower average power.)

The application of this pulsing scheme to direct thermal printing makes it possible to produce simplified multicolor thermal printers, without the need for donor ribbons. Despite their simplicity, however, these simplified printers have exhibited a measurably smaller color gamut than the less convenient thermal transfer printers. In general, the "color gamut" of a printer includes the set of all colors that it is capable of printing and is a measure of the degree to which the printer can accurately reproduce all of the colors in an image. The present invention provides an improved technique for electrically pulsing the print head elements of a direct thermal printer to enlarge the color gamut.

Figure 3:
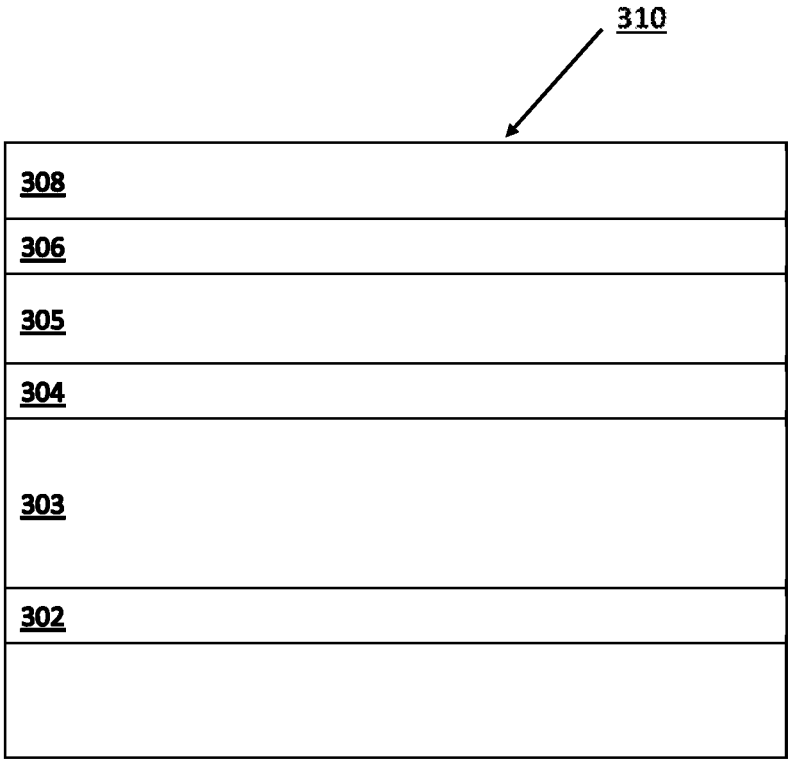
FIG. 3 is a diagram of an exemplary output medium.

In FIG. 3, an exemplary representation of a structure of the output medium 108 is illustrated. One surface of this output medium 108 carries three color forming layers 302, 304 and 306, each capable of forming a different color when heated above a respective threshold temperature $T_1$, $T_2$ and $T_3$. The three-color forming layers 302, 304 and 306 are separated by chemically inert spacing layers 303 and 305. Layer 306 is furthermore covered by an overcoat 308 that may be designed to provide protection from scratches, ultraviolet (UV) light, chemicals and the like. Printing is mediated by electrically activated print head elements 106*a-h* contacting a surface 310 of the output medium.

The spacing of the uniform pulses applied to a print head element 106*a-h* in each segment determines the average electrical power applied to the print head element and is used to select a particular one of the image-forming layers embedded in the output medium 108. The average electrical power can therefore select which color to print.

The application of electrical pulses with relatively high average electrical power (i.e., closely spaced pulses) to a print head element 106*a-h* in contact with surface 310 of the output medium can result for a short time in the formation of color in color forming layer 306 without affecting color forming layers 302 and 304. At the other extreme, the application of electrical pulses with low average electrical power (i.e., widely spaced pulses) can form color in color forming layer 302 without affecting color forming layers 304 or 306. The formation of color in the intermediate color forming layer 304 can be accomplished by thermal pulses with an intermediate value of the average electrical power.

With an average power level selected for printing on a chosen one of the color-forming layers, the optical density of the dots printed on that layer is controlled by the length of time that the print head element continues to supply the thermal pulses, and therefore by the time duration of the first portion of the corresponding segment. Portions with shorter duration produce smaller dots or dots of lower optical density that are perceived as lighter, while portions with longer duration produce larger dots or dots of higher optical density that are perceived as darker. Yet, it is found that attempts to produce dots in a particular color forming layer that are too high in optical density can result in the unintended formation of color in the other color forming layers. This unintended contamination of the color is known as color "cross-talk," and it results in a reduction in the gamut of colors that are printable by the direct-thermal printing system. The present invention provides techniques for electrically activating thermal print head elements to mitigate the effects of color cross-talk in a direct thermal printer.

As described above, supplying electrical pulses to a thermal print head enables different print head elements to print on different color forming layers of a multicolor thermal imaging member in a single pass. The line printing time for each print head element is divided into segments, each of which is further divided into a plurality of subintervals. A subinterval may contain an electrical pulse having substantially the same duration as the subinterval. All of the pulses within the segments have the same amplitude and duration.

Each segment is designated for printing on one of the color-forming layers of the output medium 108. Most commonly in a multicolor direct thermal printer, there are three color forming layers embedded in the output medium and each may form a different color. The line printing time is therefore divided into three segments.

The subintervals within each segment are further divided into two groups called portions. There are, altogether, six portions. One of the two portions of subintervals within each segment contains some subintervals in which there are pulses applied to the print head element. The pulses in this portion are spaced appropriately to cause printing on the color forming layer designated for printing during this segment. This is referred to as the "on-time" portion. The other portion of subintervals in this segment have no subintervals in which pulses are applied to the print head element. This is referred to as the "off-time" portion. The two portions together include all the subintervals in the segment.

The length of the "on-time" portion of subintervals in the segment is chosen to achieve a desired optical density of the designated color for the segment. For example, if it is desired to print the designated color at a low optical density, then the "on-time" portion of subintervals will comprise a relatively small fraction of the subintervals in the segment. The "off-time" portion, which contains no pulses, will include the remainder of the subintervals within the segment and will be relatively long.

In some instances either, or both, of the two portions of a segment may contain no subintervals. For example, if it is desired to refrain from printing on one of the three color forming layers during a particular line printing time, then the length of the "on-time" portion of subintervals during the segment designated for printing on that color forming layer may contain no subintervals, so that no pulses will issue to the print head element during that segment. The "off-time" portion of subintervals will then contain all the subintervals allocated for the segment. At the other extreme, to print the maximum optical density of the designated color for a segment it may be necessary to include all of the subintervals of the segment in the "on-time" portion, and to have an "off-time" portion containing no subintervals.

The length of the segments may also be variable, depending on the color to be printed. For example, if it is desired to print only on one of the three color forming layers during a particular line printing time, the lengths of the segments allocated to the other two color forming layers can be made zero, so that their "on-time" and "off-time" portions contain no subintervals. In this case, the "on-time" and "off-time" portions allocated to the one desired color comprise all of the subintervals in the line time.

To complete the description of the electrical pulses issued to the print head elements, it is necessary to choose the line printing time, the lengths of the three segments that make it up, and the lengths of the portions that make up each segment.

Consider first the choice of the line printing time. In general, it is beneficial for a printer to print as quickly as possible, and with a line spacing sufficiently small that the human eye is unable to discern the individual lines making up the image. These requirements together imply that the line printing time itself should be as short as possible. Therefore, the line printing time is determined by how short the three segments can be made.

Turn attention to the segment designated for printing on color forming layer 306, the color forming layer closest to the heated surface 310 of the output medium. According to prior thinking, this layer should be printed with as high an average power as possible, and therefore with a pulse spacing of just one subinterval. The pulse amplitude is likewise made as high as possible. The limitations that control these choices are the safe operating temperature of the print head elements and the melting temperatures of the materials used to fabricate the output medium. With these considerations in mind, and issuing pulses in every subinterval, it is possible to measure the number of pulses required to reach the maximum density of color forming layer 306. The product of this number and the duration of a subinterval yields the maximum time required for the segment designated for printing on this layer.

Next, consider the segment designated for printing on color-forming layer 302, the color forming layer that is farthest from heated surface 310. Prior thinking suggests that this layer should be printed with as low an average power as possible, and therefore using a very wide pulse spacing. Using pulses of the same amplitude that was determined for printing color forming layer 306, it is possible to measure the maximum pulse spacing that will result in a temperature rise to threshold temperature $T_1$, necessary for printing the maximum achievable density on color forming layer 302. In practice, however, this choice of pulse spacing is unsuitable for use in a practical printing system. It leads to lengths for this segment that are very long, and to print speeds that are consequently too low for practical applications. It is necessary instead to choose the pulse spacing for color forming layer 302 based on the lowest acceptable printing speed for the application. The time for printing this segment is, in fact, the principal contribution to the total line printing time. A suitable method for setting the pulse spacing for this segment is therefore to choose the highest value capable of achieving a suitable amount color formation in color forming layer 302 with the lowest acceptable printing speed.

The choices for pulse spacing are therefore highly constrained for the segments designated for printing on color forming layers 302 and 306. For layer 306, the pulse spacing is one subinterval, and for layer 302 is constrained by the minimum allowable print speed. The pulse spacing for color forming layer 304 is left as the principal means that can be used to influence the color gamut. The pulse spacing for color forming layer 304 must be intermediate between those used for color forming layers 302 and 306, and the choice is a compromise between the amount of unintentional printing that occurs on each of these layers.

To reach print speeds of practical use, it has been necessary to make choices that allow limited amounts of unintentional printing, during each segment, in color forming layers that are not designated for printing during that segment. This unintentional coloration results in a reduction of the gamut of colors that are printable by the printer by limiting the extent to which the full achievable optical densities of each color forming layer can be realized before its color becomes contaminated by unintentional coloration of the other color forming layers.

To provide a specific example of the effect of the contamination, a media structure of the type shown in FIG. 3 was used in which color-forming layer 306 contained a dye that produces yellow coloration when its temperature is raised above its threshold temperature $T_3$. Similarly, color-forming layer 304 contained a dye that produces magenta coloration above its threshold temperature $T_2$ and color-forming layer 302 contained a dye that produces cyan coloration above its threshold temperature $T_1$.

In this particular example, the sample media is a commercially-available product of ZINK Holdings, LLC, 114 Tived Ln E, Edison, N.J. 08837. It may be obtained as "Sprocket" media from HP, Inc., 1501 Page Mill Road, Palo Alto, Calif. 9430, through their on-line store at http://store.hp.com.

Figure 4:
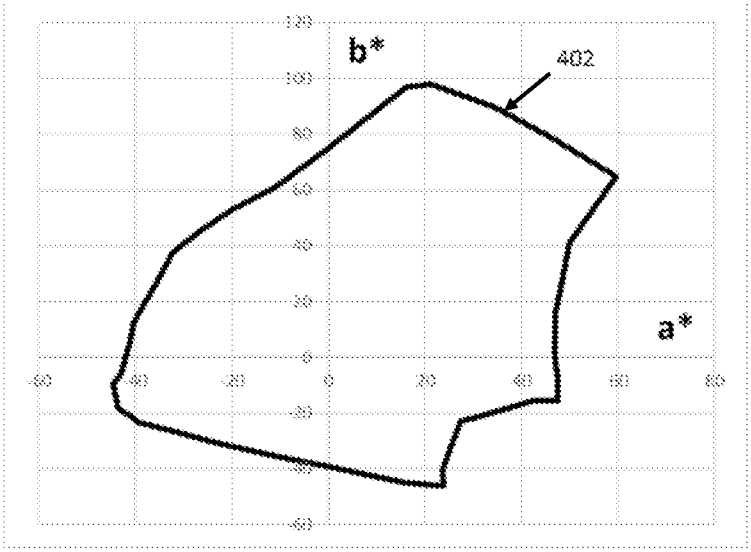
FIG. 4 illustrates the measured color gamut of an exemplary output medium.

FIG. 4 illustrates the color gamut measured for this exemplary media. The data is plotted in so-called L*a*b* coordinates, which are well-known to those of ordinary skill in the art. In these coordinates, the value L* represents "lightness", with values between 0 for black and 100 for white. For simplicity, the color gamut is represented herein as a projection of the full three-dimensional color gamut onto the two-dimensional plane formed by the a* and b* axes. In this format, the origin of the graph, at a*=0, b*=0, is the projection of the L* axis and represents neutral colors. The horizontal a* axis extends horizontally from green colors for negative a* to red/magenta colors for positive a*, while the b* extends vertically from blue colors for negative b* to yellow colors for positive b*. Each radial direction from the origin generally represents a different hue, while the distance from the origin signifies the saturation of that hue.

FIG. 4 illustrates a boundary 402 in a*,b*. This boundary encloses the two-dimensional projection of the surface of the color gamut when using an average power level of 0.283 W for printing on the yellow layer, 0.040 W for printing on the magenta layer, and 0.020 W for printing on the cyan layer. The extent of the region enclosed by this boundary is a measure of the color gamut of the medium when printed at these power levels and includes all values of a*, b* that are printable for at least some values of lightness.

The choice of an average pulse power of 0.040 W in the segment designated for printing on the magenta color forming layer involved a compromise between values that produce a larger saturation for colors with redder hues or values that favor more saturation of colors with bluer hues. The method of the present invention overcomes this compromise and can print more saturated colors both with redder, and bluer hues.

This example describes a media in which color forming layers 302, 304 and 306 formed the colors cyan, magenta and yellow, respectively. It is equally possible to place the color forming layers in a different order, or to use a different selection of colors. In these cases, the regions of hue and saturation that are affected by a change in the average electrical power used to print on the intermediate color forming layer will be different. In each case, however, there will be a compromise such that a change in the average power used for the intermediate color forming layer will cause some hues to be renderable at high saturation, while others are rendered at less than their optimum saturation.

In the method of the present invention, the choice of the average power level of the pulse stream supplied to a print head element during the segment designated for printing on the intermediate color forming layer 304 is made dynamically, on a pixel-by-pixel basis, and determined by the control circuit 102. Prior to printing each pixel of the image, the pixel color data are evaluated to determine whether the hue, saturation, and lightness of the color to be printed will be compromised by unintended printing on the color forming layers 302 or 306 when issuing pulses in the segment designated for printing on intermediate color forming layer 304. If the pixel color is away from any region of L* a* b* coordinates in which the color saturation may be compromised, then the pulse stream may be formed using a default average power. In the example provided above, for example one may use an average pulse power level of 0.040 W to print in the segment designated to print on the magenta color forming layer for such pixels.

On the other hand, if the pixel to be printed has values of hue, saturation and lightness that are outside the regions of color space that may be printed using the default average power level, then the pulse spacing may be momentarily changed for the duration of the segment of that pixel designated for printing on the magenta color forming layer to a value that is more suited to printing these values.

Figure 5:
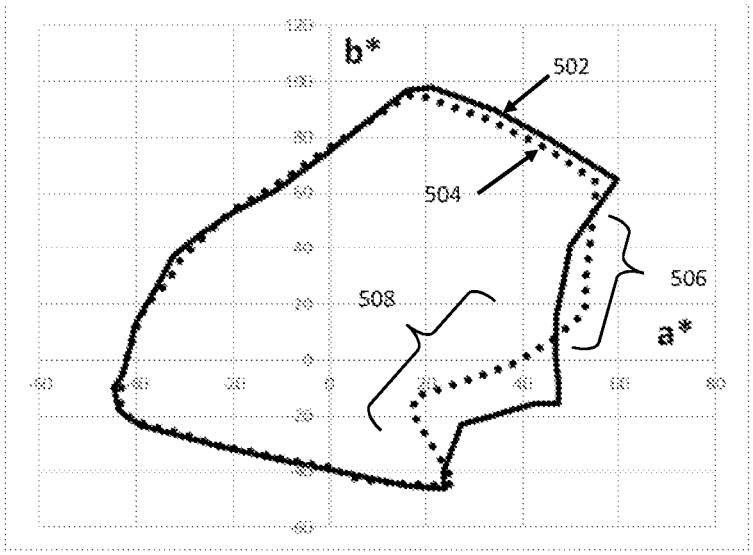
FIG. 5 illustrates the change in color gamut of the exemplary output medium with an increase in average power used for printing magenta.

For example, consider a case depicted in FIG. 5. This figure replicates as curve 502 the data illustrated in FIG. 4, in which the intermediate magenta layer was printed with a compromise average pulse power level of 0.040 W. In addition, it includes a second set of data as dotted curve 504, for which the average pulse power level for magenta was increased to 0.047 W. The use of the higher average pulse power level has led to an improvement in the saturation achievable for a selection of colors in the red portion of the diagram (506), but a degradation in the saturation achievable for another selection of colors in the blue portion of the diagram (508).

Figure 6:
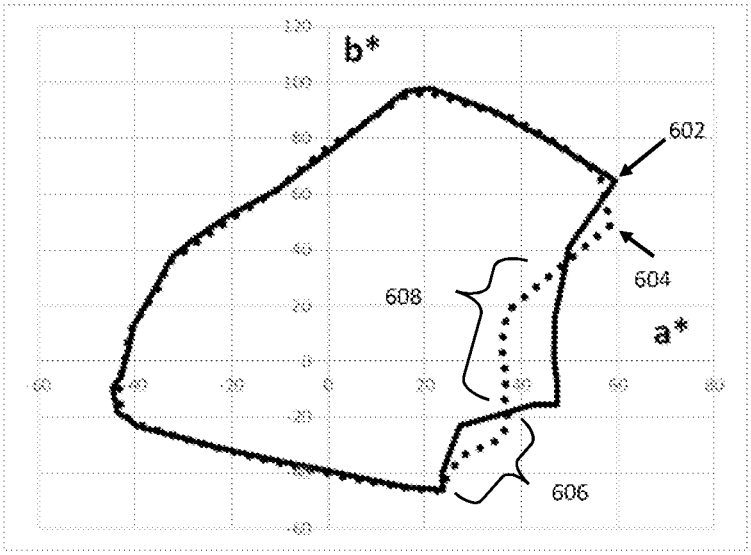
FIG. 6 illustrates the change in color gamut of the exemplary output medium with a decrease in average power used for printing magenta.

FIG. 6 makes a similar comparison for the case in which the second set of data (curve 604) is printed at a reduced average pulse power level of 0.035 W, which is lower than the compromise average pulse power level. In this case a region of improved saturation occurs in the purple portion of the diagram (606), while the region of degraded saturation occurs in the red/magenta portion (608).

This type of modification in the gamut of printable colors may be carried out dynamically, and on a pixel-by-pixel basis, to achieve the effect of a color gamut that encompasses the best achievable saturation for all hues and lightness. When printing pixels having a hue that is more red (i.e., redder) than the color of the magenta layer, the average pulse power for printing on the magenta layer may be momentarily increased for the duration of the pixel. When printing pixels with a hue that is more blue (i.e., bluer) than the color of the magenta layer, the average pulse power for printing on the magenta layer may be momentarily decreased. Indeed, for each hue and lightness that involves coloration of the magenta layer, the average pulse power for printing magenta may be set to the value that allows the greatest saturation for that hue and lightness. This may be implemented by the control circuit with the use of a lookup-table that stores values of average pulse power to use for each affected hue and lightness, or a program that computes the required average pulse power from the target hue, lightness and saturation.

It is notable that the changes described above to achieve changes in average pulse power involve the generation of pulse streams with greater or smaller pulse spacing than the default value. If the default pulse spacing for printing on the intermediate color forming layer is, for example, 1 pulse in every 7 subintervals, then a pulsing scheme using uniformly spaced pulses could only increase or decrease this value in integer steps, for example to 1 pulse in 8 subintervals, 1 pulse in 6 subintervals, and so on. This small number of choices may not include the values that are ideal for practicing the dynamically adjustable pulsing scheme described above. However, by using pulse streams with non-uniform spacing, as described in U.S. Pat. No. 7,830,405, it is possible to produce pulse streams with more finely controllable average pulse power. For example, a pulse stream with an alternating pulse spacing of 1-in-6 and 1-in-7 subintervals will result in a pulse stream with an average pulse power level that is approximately half way between that of a stream of 1-in-6 pulses and a stream of 1-in-7 pulses.

Figure 7:
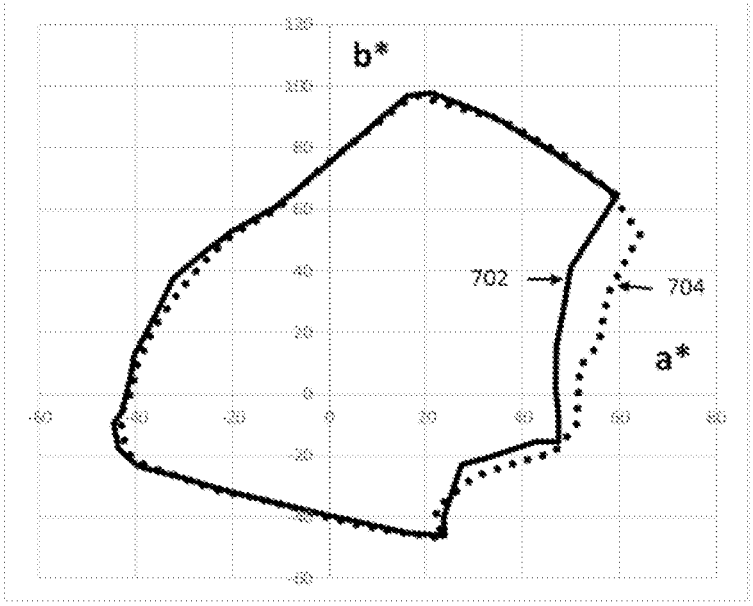
FIG. 7 illustrates the improvement of color gamut with the exemplary output medium using the method of the current invention.

FIG. 7 demonstrates the improved gamut of colors that are printable by the printer of the previous example in which the current invention is practiced. The example represents measured data using the print medium described earlier, in which color forming layers 302, 304 and 306 formed colors cyan, magenta and yellow respectively. In FIG. 7, the solid line 702 illustrates the range of hue and saturation that is available by using a prior art fixed average pulse power, chosen as a compromise between a value chosen to print more saturated color for red hues, and a value chosen to print more saturated colors for magenta and blue hues. Dotted line 704 illustrates the larger gamut of colors available for printing when using the method of the current invention by dynamically adjusting, on a pixel-by-pixel basis, the average pulse power of the segment designated for printing on the magenta color forming layer, based on the hue, saturation, and lightness of the pixel to be printed by the print head element.

Figure 8:
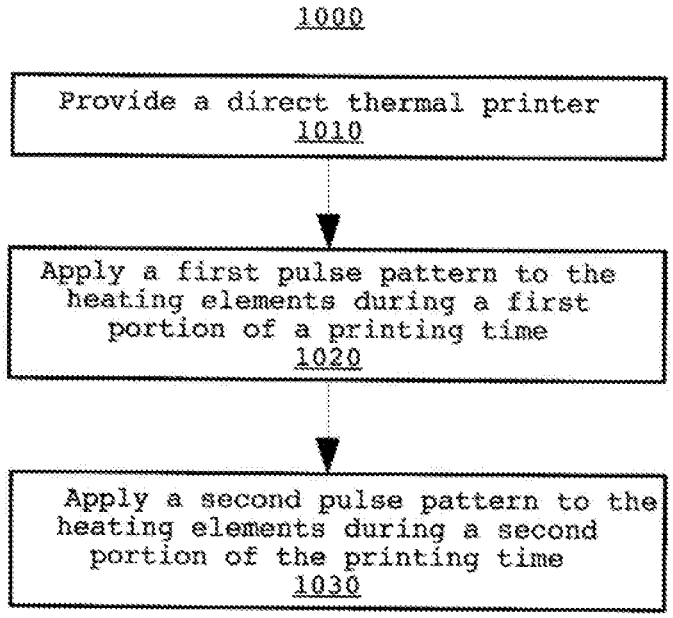
FIG. 8 is a flow diagram.

As shown in FIG. 8, a process 1000 includes providing (1010) a direct thermal printer. The direct thermal printer includes a thermal print head having heating elements.

Process 1000 applies (1020) a first pulse pattern to the heating elements during a first portion of a printing time, the first pulse pattern comprising a first plurality of pulses having a first average power, each of the first plurality of pulses having a common energy.

Process 1000 applies (1030) a second pulse pattern to the heating elements during a second portion of the printing time, the second pulse pattern comprising a second plurality of pulses having a second average power that differs from the first average power, each of the second plurality of pulses having the common energy.

It would be appreciated by those skilled in the art that various changes and modifications can be made to the illustrated embodiments without departing from the spirit of the present invention. All such modifications and changes are intended to be within the scope of the present invention except as limited by the scope of the appended claims.

The foregoing written specification is considered to be sufficient to enable one skilled in the art to practice the present aspects and embodiments. The present aspects and embodiments are not to be limited in scope by examples provided, since the examples are intended as a single illustration of one aspect and other functionally equivalent embodiments are within the scope of the disclosure. Various modifications in addition to those shown and described herein will become apparent to those skilled in the art from the foregoing description and fall within the scope of the appended claims. The advantages and objects described herein are not necessarily encompassed by each embodiment. Those skilled in the art will recognize, or be able to ascertain using no more than routine experimentation, many equivalents to the specific embodiments described herein. Such equivalents are intended to be encompassed by the following claims.

All references disclosed herein are incorporated by reference in their entirety.

What is claimed is:

1. A system comprising:

a control circuit; and one or more print heads linked to the control circuit, each of the one or more print heads containing a linear array of print head elements that print on a direct thermal output medium, the output medium transported past the print head elements to produce a two-dimensional print image, the print image resulting from heating of the output medium by dynamically adjusting an average power of a pulse stream applied to the individual print head elements to heat them, wherein the output medium comprises three color forming layers, each capable of forming a different color when heated above a respective threshold temperature $T_1$, $T_2$ and $T_3$, the three color forming layers separated by chemically inert spacing layers, and wherein dynamically adjusting the average applied power comprises evaluating pixel color data prior to printing each pixel of an image to determine whether a hue and saturation of the color to be printed will be compromised by unintended printing on a first and second color forming layers when issuing pulses in a segment designated for printing on an intermediate color forming layer located between the first and second color forming layers.

2. The system of claim 1 wherein a pulse stream with a default average power is applied if the evaluated pixel color data is within a region of L*a*b* color-space in which the color saturation may be compromised.

3. The system of claim 1 wherein a pulse stream with a modified average power is applied if the evaluated pixel color data indicates the evaluated pixel has a hue and saturation that are beyond values that can be printed using the default average applied power.

4. A direct thermal printer comprising a control circuit; and one or more print heads linked to the control circuit, each of the one or more print heads containing a linear array of print head elements that print on a direct thermal output medium, the output medium transported past the print head elements to produce a two-dimensional print image, the print image resulting from heating of the output medium by dynamically adjusting an average power of a pulse stream applied to the individual print head elements to heat them, wherein the output medium comprises three color forming layers, each capable of forming a different color when heated above a respective threshold temperature $T_1$, $T_2$ and $T_3$, the three color forming layers separated by chemically inert spacing layers, and wherein dynamically adjusting the average applied power comprises evaluating pixel color data prior to printing each pixel of an image to determine whether a hue and saturation of the color to be printed will be compromised by unintended printing on a first and second color forming layers when issuing pulses in a segment designated for printing on an intermediate color forming layer located between the first and second color forming layers.

5. The direct thermal printer of claim 4 wherein a pulse stream with a default average power is applied if the evaluated pixel color data is within a region of L*a*b* color-space in which the color saturation may be compromised.

6. The direct thermal printer of claim 4 wherein a pulse stream with a modified average power is applied if the evaluated pixel color data indicates the evaluated pixel has a hue and saturation that are beyond values that can be printed using the default average applied power.

* * * * *